US007943566B2

(12) United States Patent
Uitenbroek et al.

(10) Patent No.: US 7,943,566 B2
(45) **Date of Patent: *May 17, 2011**

(54) DRYER SHEET AND METHODS FOR MANUFACTURING AND USING A DRYER SHEET

(75) Inventors: David Uitenbroek, Sun Prairie, WI (US); John James Blanz, Mosinee, WI (US)

(73) Assignee: Wausau Paper Mills, LLC, Mosinee, WI (US)

( * ) Notice: Subject to any disclaimer, the term of this patent is extended or adjusted under 35 U.S.C. 154(b) by 108 days.

This patent is subject to a terminal disclaimer.

(21) Appl. No.: 11/529,725

(22) Filed: Sep. 26, 2006

(65) Prior Publication Data

US 2008/0076696 A1 Mar. 27, 2008

Related U.S. Application Data

(60) Provisional application No. 60/872,417, filed on Jun. 21, 2006.

(51) Int. Cl.
*C11D 17/00* (2006.01)

(52) U.S. Cl. ..... 510/520

(58) Field of Classification Search ..... 510/520
See application file for complete search history.

(56) References Cited

U.S. PATENT DOCUMENTS

| | | | | |
|---|---|---|---|---|
| 3,442,692 | A | 5/1969 | Gaiser | |
| 3,686,025 | A | 8/1972 | Russell | |
| 3,944,694 | A | 3/1976 | McQueary | |
| 4,022,938 | A * | 5/1977 | Zaki et al. | 427/242 |
| 4,049,858 | A | 9/1977 | Murphy | |
| 4,834,895 | A | 5/1989 | Cook et al. | |
| 5,041,230 | A | 8/1991 | Borcher, Sr. et al. | |
| 5,142,023 | A | 8/1992 | Gruber et al. | |
| 5,145,595 | A | 9/1992 | Morris et al. | |
| 5,234,610 | A | 8/1993 | Gardlik et al. | |
| 5,258,488 | A | 11/1993 | Gruber et al. | |
| 5,274,059 | A | 12/1993 | Kato et al. | |
| 5,274,073 | A | 12/1993 | Gruber et al. | |
| 5,338,822 | A | 8/1994 | Gruber et al. | |
| 5,357,035 | A | 10/1994 | Gruber et al. | |
| 5,359,026 | A | 10/1994 | Gruber | |
| 5,476,599 | A | 12/1995 | Rusche et al. | |
| 5,484,881 | A | 1/1996 | Gruber et al. | |
| 5,536,807 | A | 7/1996 | Gruber et al. | |
| 5,562,847 | A | 10/1996 | Waite et al. | |
| 5,594,095 | A | 1/1997 | Gruber et al. | |
| 5,681,806 | A | 10/1997 | Trinh et al. | |
| 6,357,137 | B1 | 3/2002 | Childs et al. | |
| 6,506,873 | B1 | 1/2003 | Ryan et al. | |
| 2001/0009699 | A1 | 7/2001 | Smith et al. | |
| 2002/0096274 | A1 * | 7/2002 | Lindstrom et al. | 162/72 |
| 2005/0014673 | A1 | 1/2005 | Kwitkowski et al. | |
| 2005/0092451 | A1 * | 5/2005 | Choi et al. | 162/146 |
| 2006/0207735 | A1 | 9/2006 | Blanz | |

OTHER PUBLICATIONS

Shaklee, Soft Fabric Fragrance free Dryer Sheets, http://www.shaklee.net/cherylschell/product/00306, printed Apr. 23, 2008.

"Rayon Fiber (Viscose)," http://fibersource.com/f-tutor/rayon.htm, 5 pages, date printed Sep. 15, 2006.

"Lyocell Fiber, Lyocell Staple Fiber," http://www.fibersource.com/f-tutor/lyocell.htm, 1 page, date printed Sep. 15, 2006.

"Rayon," http://en.wikipedia.org/wiki/Rayon, 4 pages, date printed Sep. 18, 2006.

"Lyocell—One Fiber, Many Faces," http://ohioline.osu.edu/hyg-fact/5000/5572.html, 5 pages, date printed Sep. 18, 2006.

"Lyocell," http://en.wikipedia.org/wiki/Lyocell, 2 pages, date printed Sep. 18, 2006.

* cited by examiner

*Primary Examiner* — John R Hardee
(74) *Attorney, Agent, or Firm* — Merchant & Gould, P.A.

(57) ABSTRACT

A dryer sheet is provided that includes a nonwoven substrate comprising a mixture of natural fiber and polylactide fiber, and a fabric conditioning agent. The dryer sheet, if desired, can be provided so that it satisfies the test for biodegradability according to ASTM D 6868-03. A method for manufacturing and a method for using a dryer sheet are provided.

24 Claims, No Drawings

DRYER SHEET AND METHODS FOR MANUFACTURING AND USING A DRYER SHEET

This application claims priority to U.S. Provisional Application Ser. No. 60/872,417 that was filed with the United States Patent and Trademark Office on Jun. 21, 2006. The entire disclosure of U.S. Provisional Application Ser. No. 60/872,417 is incorporated herein by reference.

FIELD OF THE INVENTION

The present invention relates to a dryer sheet, and to methods for using a dryer sheet. The dryer sheet includes a nonwoven substrate that contains natural fiber and polylactide fiber, and fabric conditioning agent. The dryer sheet can be placed in a laundry dryer to impart properties such as softness, anti-static, odor control, non-wrinkle, or fragrance to the laundry as the laundry dries.

BACKGROUND OF THE INVENTION

Dryer sheets are commonly available for use in a dryer with a load of laundry for imparting anti-static properties, fabric softening properties, and fragrance to the laundry during a drying cycle. Exemplary dryer sheets are available under the names Bounce® and Downy® from The Procter & Gamble Company. In general, the dryer sheet includes a nonwoven fabric substrate and a composition that includes an anti-static agent or fabric softening agent, and a fragrance. During the drying cycle, the temperature increases as the laundry dries, causing the anti-static agent or the fabric softening agent to melt and transfer from the nonwoven substrate to the laundry. Dryer sheets are generally provided for single use, and are discarded after use.

Dryer sheets containing fabric softeners are described by U.S. Pat. No. 3,442,692 to Gaiser; U.S. Pat. No. 3,686,025 to Morton; U.S. Pat. No. 4,834,895 to Cook et al.; U.S. Pat. No. 5,041,230 to Borcher, Sr. et al.; and U.S. Pat. No. 5,145,595 to Morris et al.

SUMMARY OF THE INVENTION

A dryer sheet is provided according to the invention. The dryer sheet includes a nonwoven substrate comprising a mixture of natural fiber and polylactide fiber, and a fabric conditioning agent loaded on the nonwoven substrate. The mixture of natural fiber and polylactide fiber can comprise about 0.5 wt. % to about 75 wt. % of the polylactide fiber and about 10 wt. % to about 95 wt. % of the natural fiber. An exemplary form of the natural fiber is wood fiber.

A method for manufacturing a dryer sheet is provided according to the invention. The method comprises forming, by a wet laid process, a nonwoven substrate comprising natural fiber and polylactide fiber. The method additionally includes loading the nonwoven substrate with a fabric conditioning agent to form the dryer sheeting. The mixture can comprise about 0.5 wt. % to about 75 wt. % of the polylactide fiber and about 10 wt. % to about 95 wt. % of the natural fiber. In addition, the natural fiber can comprise wood fiber.

A method for using a dryer sheet is provided according to the invention. The method includes a step of drying wet laundry in a tumble-type dryer in the presence of a dryer sheet, wherein the dryer sheet comprises a nonwoven substrate containing natural fiber and polylactide fiber and is loaded with a fabric conditioning agent.

A dryer sheet is provided according to the invention wherein the dryer sheet comprises a nonwoven substrate and a fabric conditioning agent loaded on the nonwoven substrate. The nonwoven substrate can include natural fiber, polylactide fiber, or a mixture thereof natural fiber and polylactide fiber. The fabric conditioning agent can comprise a tallow based quaternary ammonium compound or a vegetable based quaternary ammonium compound. In addition, the dryer sheet can be characterized as biodegradable according to ASTM D 6868-03.

DETAILED DESCRIPTION

A dryer sheet can be used in a dryer for imparting fabric conditioning properties to laundry during a drying operation. In general, fabric conditioning properties include properties such as softness, anti-static, odor control, non-wrinkle, fragrance, or a mixture thereof, that can be imparted to the laundry.

The dryer sheet can be provided as a nonwoven substrate and can include a fabric conditioning agent provided on the substrate. The fabric conditioning agent transfers to the laundry during a drying operation to impart fabric conditioning properties to the fabric. At an activation temperature that is achieved during a drying cycle in a dryer, at least a portion of the fabric conditioning agent transfers from the nonwoven substrate to the laundry to impart fabric conditioning properties to the laundry. The activation temperature refers to the temperature at which the fabric conditioning agent transfers to the laundry.

The dryer sheet can be provided from components that are considered biodegradable or compostable. The terms biodegradable or compostable, are meant to refer to the ability of the dryer sheet to undergo degradation via biodegradation or hydrolysis under conditions favorable to biodegradation or hydrolysis (e.g., composting environment at 95% relative humidity and 180° F.) so that at least 95% of the components are considered degraded within a time period of about 90 days. The dryer sheet can be manufactured from only materials that are considered biodegradable or compostable, or the dryer sheet can be manufactured from a combination of materials that are considered biodegradable or compostable and materials that do not satisfy the biodegradable or compostable test. In addition, the dryer sheet can be provided so that it is characterized as biodegradable under ASTM D 6868-03. Although ASTM D 6868-03 refers to the definition of biodegradability for plastics used as coatings on paper, this definition can be used for determining the biodegradability of paper products.

Laundry refers to any textile or fabric material that can be processed in a dryer for the removal of water. Wet laundry refers to textile or fabric material having a water content resulting from a washing operation. Wet laundry is commonly dried in a dryer. Exemplary types of items that can be characterized as laundry include clothing towels, sheets, and window treatments.

The dryer in which the dryer sheet according to the invention can be used to impart fabric softening properties to laundry includes any type of dryer that uses heat and agitation or heat and airflow to remove water from the laundry. An exemplary dryer that can be used includes a tumble-type dryer where the laundry is provided within a rotating drum that causes the laundry to tumble during the operation of the dryer. Tumble-type dryers are commonly found in residences and in commercial and industrial laundry operations.

Nonwoven Substrate

The dryer sheet includes a nonwoven substrate and a fabric conditioning agent loaded onto the nonwoven substrate. The nonwoven substrate can be formed from a mixture of natural fiber and polylactide fiber. The substrate can include a sufficient amount of polylactide fiber to provide the nonwoven substrate with desired cloth or hand feel characteristics, and to provide the nonwoven substrate with desired porosity.

Natural fiber refers to fiber formed from plants or animals. Natural fibers are not fibers that are formed as a result of extrusion or spinning. The natural fibers can be obtained from a source of fiber using techniques such as chemical pulping, chemical mechanical pulping, semi chemical pulping, or mechanical pulping. Natural fibers from plants are often referred to as cellulosic fibers.

Exemplary natural fibers that can be used to form the nonwoven substrate include wood fibers and non-wood natural fibers such as vegetable fibers, cotton, various straws (e.g., wheat, rye, and others), various canes (e.g., bagasse and kenaf), silk, animal fiber (e.g., wool), grasses (e.g., bamboo, etc.), hemp, corn stalks, abaca, etc.

Wood fiber can be obtained from wood pulp. The wood pulp can include hardwood fibers, softwood fibers, or a blend of hardwood fibers and softwood fibers. The pulp can be provided as cellulose fiber from chemical pulped wood, and can include a blend from coniferous and deciduous trees. By way of example, wood fibers can be from northern hardwood, northern softwood, southern hardwood, or southern softwood. Hardwood fibers tend to be more brittle but are generally more cost effective for use because the yield of pulp from hardwood is higher than the yield of pulp from softwood. The pulp can contain about 0 to about 70% hardwood fibers based on the weight of the fibers. Softwood fibers have desired paper making characteristics but are generally more expensive than hardwood fibers. The pulp can contain about 0 to about 100% softwood fibers based on the weight of the fibers. The pulp can contain a blend of hardwood and softwood fibers.

The natural fibers can be extracted with various pulping techniques. For example, mechanical or high yield pulping can be used for stone ground wood, pressurized ground wood, refiner mechanical pulp, and thermomechanical pulp. Chemical pulping can be used incorporating kraft, sulfite, and soda processing. Semi-chemical and chemi-mechanical pulping can also be used which includes combinations of mechanical and chemical processes to produce chemi-thermomechanical pulp.

The natural fibers can also be bleached or unbleached. One of skill in the art will appreciate that the bleaching can be accomplished through many methods including the use of chlorine, hypochlorite, chlorine dioxide, oxygen, peroxide, ozone, or a caustic extraction.

The pulp can include a recycle source for reclaimed fiber. Exemplary recycle sources include post-consumer waste (PCW) fiber, office waste, and corrugated carton waste. Post-consumer waste fiber refers to fiber recovered from paper that is recycled after consumer use. Office waste refers to fiber obtained from office waste, and corrugated carton waste refers to fiber obtained from corrugated cartons. Additional sources of reclaimed fiber include newsprint and magazines. Reclaimed fiber can include both natural and synthetic fiber. Incorporation of reclaimed fiber in the nonwoven substrate can aid in efficient use of resources and increase satisfaction of the end user of the dryer sheet.

Refining is the treatment of pulp fibers to develop their papermaking properties. Refining increases the strength of fiber to fiber bonds by increasing the surface area of the fibers and making the fibers more pliable to conform around each other, which increases the bonding surface area and leads to a denser sheet, with fewer voids. Most strength properties of paper increase with pulp refining, since they rely on fiber to fiber bonding. The tear strength, which depends highly on the strength of the individual fibers, has a tendency to decrease with refining. Refining of pulp increases the fibers flexibility and leads to a denser substrate. This means bulk, opacity, and porosity decrease (densometer values increase) with refining. Fibrillation is a result of refining paper fibers. Fibrillation is the production of rough surfaces on fibers by mechanical and/or chemical action; refiners break the outer layer of fibers, e.g., the primary cell wall, causing the fibrils from the secondary cell wall to protrude from the fiber surfaces.

The fibers can be refined so that the resulting nonwoven substrate provides the desired Canadian Standard Freeness value. In general, less refined fiber can provide a nonwoven substrate having more holes and voids and thereby permitting greater penetration into the nonwoven substrate. It may be desirable to provide a desired level of refining to control the presence of holes or voids so that the nonwoven substrate can contain a desired amount or loading of the fabric conditioning agent.

Polylactide fiber refers to fiber containing polylactide as a component of the fiber. The fiber can be provided entirely from polylactide or it can be provided as a blend of polylactide and another polymer. The polylactide can be a homopolymer of polylactide or a copolymer of polylactide and one or more polymer or comonomer.

Polylactide refers to a polymer formed from lactide or lactic acid. It should be understood that the nomenclature relating to polylactide can be confusing. Sometimes, people refer to the polymer resulting from the polymerization of lactic acid as polylactic acid, and the polymer resulting from the polymerization of lactide as polylactide. At other times, people refer to the polymer resulting from the polymerization of lactic acid or from the polymerization of lactide as polylactic acid or as polylactide. As used herein, the term "polylactide" is intended to refer to polymers prepared as a result of polymerizing lactic acid or as a result of polymerizing lactide. Accordingly, polylactic acid is a form of polylactide. The confusion relating to the nomenclature of polylactide may be seen as a result of how polylactide is formed. Lactic acid is a fairly common starting material as a result of fermentation. Lactic acid can be polymerized as a result of a condensation reaction to form polylactic acid and water. Starting with lactic acid, it is difficult to form relatively high molecular weight polylactic acid. The relatively low molecular weight polylactic acid formed from polymerizing lactic acid can be depolymerized to form lactide. Lactide is a cyclic dimer of lactic acid. Lactide can then be polymerized to form relatively high molecular weight polylactide.

Polylactide can be formed to relatively high molecular weight from L-lactide, D-lactide, meso-lactide or a mixture thereof. The L-lactide is structured from two S-lactic acid residuals, the D-lactide is structured from two R-lactic acid residuals, and the meso-lactide is structured from both an S-lactic acid residual and an R-lactic acid residual. The reference to "residuals" of lactic acid refers to the portion of the lactic acid molecule remaining in lactide or polylactide. For example, two lactic acid residuals can combine with a molecule of water to form two lactic acid molecules.

Various techniques are available for forming fiber from polylactide. For example, see U.S. Pat. No. 6,506,873, the entire disclosure of which is incorporated herein by reference. Exemplary techniques for forming polylactide fibers include melt blowing, spunbonding, and melt spinning.

Polylactide polymers which can be used to form fibers for preparing the nonwoven substrate are available under the tradename EcoPLA™ from NatureWorks LLC. Polylactide fibers can be obtained as described in U.S. Pat. No. 6,506,873. Polylactide that can be used to form the fiber includes the polylactide described in U.S. Pat. Nos. 5,142,023; 5,274,059; 5,274,073; 5,258,488; 5,357,035; 5,338,822; 5,359,026; 5,484,881; 5,536,807; and 5,594,095. It should be understood that polylactide fibers refer to fibers containing polylactide, and that can additionally contain copolymers of polylactide and another polymer, blends of polylactide and another polymer, or mixtures thereof.

The polylactide fiber for use in forming the nonwoven substrate of the dryer sheet should be sufficiently melt resistant so that it does not melt during the drying cycle. Melting of the polylactide fiber may take the form of a deposit of the polylactide fiber on laundry in the dryer. Accordingly, in order to avoid damaging the laundry, the polylactide should have a sufficiently high melting point so that it does not transfer to the laundry. During a drying cycle, dryers often achieve temperatures in a range of about 120° F. to about 185° F. Accordingly, the polylactide fibers can have a melting temperature of at least about 200° F. to resist melting during a drying cycle in a dryer.

The nonwoven substrate can contain a sufficient amount of the polylactide fiber so that the dryer sheet exhibits desirable cloth and hand feel characteristics. In general, the cloth or hand feel characteristics of the dryer sheet can be provided so that they are similar to the cloth or hand feel characteristics of commercial dryer sheet products such as those available under the names Bounce® and Downy® from The Procter & Gamble Company. The natural fiber can provide a nonwoven substrate for use as a dryer sheet that is relatively inexpensive, but has a tendency to provide the dryer sheet with stiffness. Polylactide fiber can be included in the nonwoven substrate in an amount sufficient to improve the cloth and hand feel characteristics of the nonwoven substrate.

The nonwoven substrate can contain a sufficient amount of the polylactide fiber so that the resulting nonwoven substrate has a desired level of porosity or air permeability. In general, providing the nonwoven substrate with a desired level of air permeability allows the nonwoven substrate to handle or contain a desired amount or loading of fabric conditioning agent. The air permeability of the nonwoven substrate can be controlled to allow for sufficient loading of the fabric conditioning agent onto the nonwoven substrate. It can be desirable for the nonwoven substrate to have an air permeability of at least 6 CFM (cubic feet per minute per $ft^2$) according to Tappi T 251CM-85.

The nonwoven substrate can be prepared from fibers containing natural fiber, polylactide fiber, or a mixture of natural fiber and polylactide fiber. The nonwoven substrate can contain 0 wt. % to 100 wt. % natural fiber and can contain 0 wt. % to 100 wt. % polylactide fiber, based on the weight of the fiber of the nonwoven substrate. In order to provide the nonwoven substrate with desired cloth and hand feel properties or to provide the nonwoven substrate with desired air permeability, the nonwoven substrate can be prepared from a mixture of natural fiber and polylactide fiber. The nonwoven substrate can be prepared from a mixture containing about 10 wt. % to about 95 wt. % natural fiber, about 20 wt. % to about 92 wt. % natural fiber, about 40 wt. % to about 90 wt. % natural fiber, or about 50 wt. % to about 85 wt. % natural fiber. The nonwoven substrate can be prepared from a mixture containing about 0.5 wt. % to about 75 wt. % polylactide fiber, about 2 wt. % to about 60 wt. % polylactide fiber, about 10 wt. % to about 55 wt. % polylactide fiber, or about 20 wt. % to about 50 wt. % polylactide fiber. The weight percent of fiber is based upon the fiber content of the nonwoven substrate.

It can be desirable to provide the polylactide fiber having a length that is as long as possible to form a nonwoven substrate on a paper making machine in order to obtain the maximum benefit of the presence of the polylactide fiber. In general, it is expected that by using a longer polylactide fiber, it may be possible to use less of the polylactide fiber prepared with a nonwoven substrate that uses shorter fiber. In general, an exemplary polylactide fiber length that can be used on a paper making machine is about 3 mm to about 6 mm (about ⅛ inch to about ¼ inch). It may be desirable to provide the polylactide fiber having a length of up to about 2 inches.

The polylactide fiber can have a denier selected to provide desired cloth or hand feel characteristics. In general, a small denier can be used to enhance the cloth or hand feel characteristics. Fibers having a larger denier tend to be more coarse. Accordingly, the polylactide fiber can have a denier of about 0.5 to about 20, a denier of about 0.5 to about 10, a denier of about 0.5 to about 5, or a denier of about 1.0 to about 2.

The nonwoven substrate can be provided having a basis weight that provides a dryer sheet having a desired size while containing a sufficient amount of the fabric conditioning agent for transfer to laundry during drying in a dryer. In addition, the basis weight of the nonwoven substrate helps provide the resulting dryer sheet with a desired weight. In general, the nonwoven substrate can have a basis weight of about 10 lb/3,000 $ft^2$ to about 30 lb/3,000 $ft^2$.

The nonwoven substrate can be formed by a wet laid process. Exemplary wet laid processes that can be used include those wet laid processes that are generally considered paper making processes and wet laid processes that are often used to make nonwovens other than paper or in addition to paper. Exemplary paper making wet laid processes include those processes carried out on a paper making machine such as a Fourdrinier machine. Additional paper making processes include processes carried out on a twin wire machine or on a cylinder machine. An additional wet laid process that can be used for making nonwovens can be carried out on as an inclined wire machine. An exemplary inclined wire machine is a Hydroformer machine.

The fibers for use in forming the nonwoven substrate can be fibers that are convenient for use on a paper making machine. During a paper making process, a wet mass of fibers is typically applied to a wire or screen to form a substrate, and the substrate is subsequently dried by running the substrate over heated cans.

When processing natural fibers such as wood pulp to form the nonwoven substrate, it can be desirable to process the fiber in a wet laid process such as on a paper making machine. However, when the natural fiber is not wood pulp or when the fiber is entirely or almost entirely polylactide fiber, it may be desirable to use another nonwoven substrate forming technique such as air laid, spun bond, melt blown, or hydro entanglement to form the nonwoven substrate.

The nonwoven substrate can include additives such as a wet strength additive to help hold the fiber together. Exemplary wet strength additives that can be used to hold the fiber together and maintain strength when wet include urea formaldehyde resin (e.g., Amres PR-247HV from Georgia Pacific Resins), melamine formaldehyde resin (e.g., Parez 607 from Cytec Industries, Inc.), polyamides, polyacrylamides, polyimines, polyethyleneimines (PEI), wet end latexes, size press latexes (e.g., polyacrylates, styrene, butadiene, copolymers, styrene acrylic copolymers, ethylene, vinyl acetate copolymers, nitrile rubbers, polyvinyl chloride, polyvinyl acetate, ethylene acrylate copolymers, vinyl acetate acrylate copolymers, or mixtures thereof). An exemplary polyamide is polyamide epichlorohydrin resin (PAE) (Kymene 970 resin available from Hercules, Inc.). If the nonwoven substrate includes a wet strength additive, the nonwoven substrate can contain about 0.1 wt. % to about 8 wt. % of the wet strength additive, or about 1 wt. % to about 4 wt. % of the wet strength additive.

The nonwoven substrate can include a binder to help hold the fiber together. Exemplary binders that can be used include latexes. The addition of a binder such as a latex can be referred to as a form of chemical bonding. The latexes can be provided as polyacrylates, styrene, butadiene, copolymers, styrene acrylic copolymers, ethylene, vinyl acetate copolymers, nitrile rubbers, polyvinyl chloride, polyvinyl acetate, ethylene acrylate copolymers, vinyl acetate acrylate copolymers, or mixtures thereof. When the nonwoven substrate includes a binder, the nonwoven substrate can include the binder in an amount of about 0.5 wt. % to about 25 wt. %, and can include the binder in an amount of about 2 wt. % to about 15 wt. %.

The nonwoven substrate can be provided without a binder. It should be understood that the term "binder" refers to a chemical binding agent. Other forms of binding can occur in the nonwoven substrate. For example, there can be mechanical binding. An example of mechanical binding includes entanglement. The fibers of the nonwoven substrate can be hydroentangled, if desired. In addition, binding can include hydrogen bonding (e.g., of the cellulosic fibers), or mechanical bonding (hydroentanglement, needle punch, or stitch bonding).

Creping

The nonwoven substrate can be creped. In general, creping a substrate can be desirable to modify properties of the substrate. For example, creping can be used to enhance loft or hand feel properties, increase flexibility, increase stretch, and/or increase openness of the substrate relative to the flat sheet. The flat sheet refers to the nonwoven substrate prior to creping. Once the nonwoven substrate has been creped, it can be referred to as a creped substrate. It can be fairly convenient to crepe the nonwoven substrate after it has been prepared as a result of a wet laid process. Once the nonwoven substrate has been formed as a result of the wet laid process, a creping step can be conveniently added to the process to provide a desired level of creping. Techniques for creping a nonwoven substrate are disclosed in U.S. application Ser. No. 11/080,346 that was filed with the United States Patent and Trademark Office on Mar. 15, 2005. The entire disclosure of U.S. application Ser. No. 11/080,346 is incorporated herein by reference.

One of skill in the art will appreciate that many different methods may be used to crepe paper. An exemplary creping press can include a first crepe press roll made of a soft material and a second crepe press roll made of a more rigid material such as steel. The substrate can travel between the rolls and adhere to and follow the second crepe press roll. The substrate can be creped off the second crepe press roll using a doctor blade (or creping blade) to produce a rough creped paper substrate.

The substrate that is creped can be characterized as wet or dry. Creping a wet substrate can be referred to as wet creping, and creping a dry substrate can be referred to as dry creping. In the case of wet creping, it can be desirable for the substrate to have a water content of about 20 wt. % to about 65 wt. %. In addition, the substrate can have a moisture content of about 35 wt. % to about 60 wt. %. Dry creping is generally characterized as creping a substrate having a moisture content of less than about 20 wt. %.

Creping can impart a degree of stretchability or elongation to a substrate. Elongation properties may be measured according to TAPPI test T494. The substrate can be creped to provide a creped paper product having an elongation of at least about 1% in the machine direction (MD) according to TAPPI test T494. In addition, the substrate can be creped to provide an elongation of at least about 2% in the machine direction, and can be creped to provide an elongation of at least 3% in the machine direction, according to TAPPI test T494. Although the substrate can be creped to provide a crepe paper product having the desired elongation, it is generally expected that the elongation will be less than about 30% in the machine direction (MD) according to TAPPI test T494. The creped paper product can be provided having an elongation of about 3% to about 15% in the machine direction (MD) according to TAPPI test T494, and can be provided having an elongation of about 4% to about 10% in the machine direction according to TAPPI test T494.

The creping process results in the formation of creping lines on the rough creped paper substrate. In general, creped paper having a relatively low number of lines per lineal inch can be associated with heavy papers that are generally more abrasive and rougher compared with creped paper having more crepe lines per lineal inch to produce lighter papers that are finer and smoother. It should be understood that this is just a general characterization and heavy papers can include a higher number of crepe lines per lineal inch than lighter papers. When providing more abrasive and rougher creped paper, the creping process can provide about 5 to about 15 crepe lines per lineal inch. For finer and smoother creped paper products, it may be desirable to provide at least about 15 crepe lines per lineal inch. It is expected that the number of crepe lines can be as large as desired for a particular application. For example, it may be desirable to provide creped paper having in excess of 100 crepe lines per lineal inch. For example, it may be desirable to provide creped paper having up to about 200 crepe lines per lineal inch. The creped paper product can include crepe lines of about 15 to about 100 per lineal inch, about 17 to about 50 per lineal inch, and about 20 to about 30 per lineal inch.

Fabric Conditioning Agent

The fabric conditioning agent is the component that transfers to the laundry to impart fabric conditioning properties to the laundry. In general, the fabric conditioning agent can be any component that remains with the nonwoven sheet until an activation temperature is achieved during the drying operation and the fabric softening agent then transfers to the laundry to impart fabric softening properties to the laundry. An exemplary activation temperature that causes the fabric conditioning agent to transfer to the laundry can be about 120° F. Exemplary fabric conditioning agents include those agents that provide anti-static, softening, odor control, non wrinkling, and fragrance to laundry during a drying operation.

The fabric conditioning agent can be selected as a biodegradable or compostable fabric conditioning agent. In general, the fabric conditioning agent can be provided from a tallow source or from a vegetable source. Exemplary tallow based quaternary ammonium compounds that can be used include those available under the names DS 100, DS 110, DS 150 and DS 350 available from Degussa. An exemplary vegetable based quaternary ammonium compound that can be used is available under the name DXPSMS-0093-5521E from Degussa. It is understood that these tallow based and vegetable based quaternary ammonium compounds are considered biodegradable or compostable.

Exemplary quaternary ammonium compounds that provide fabric softening properties or anti-static properties and that can be loaded onto the nonwoven substrate include alkylated quaternary ammonium compounds, ring or cyclic quaternary ammonium compounds, aromatic quaternary ammonium compounds, diquaternary ammonium compounds, alkylated quaternary ammonium compounds, amidoamine quaternary ammonium compounds, ester quaternary ammonium compounds, and mixtures thereof.

Exemplary fabric softening agents that can be used in forming the dryer sheet include those described in U.S. Pat. Nos. 6,357,137; 5,234,610; 5,562,847; 5,681,806; and 5,476,599. The disclosures of these fabric softening agents are incorporated herein by reference.

Dryer Sheet

The dryer sheet can be prepared by loading the fabric conditioning agent onto the nonwoven substrate. In general, the amount of the fabric conditioning agent loaded onto the nonwoven substrate depends on the amount of the fabric conditioning agent that is desired to be imparted to the laundry during the drying operation. In general, the loading of the fabric conditioning agent onto the nonwoven substrate can be characterized based on a ream (3000 $ft^2$) of the nonwoven substrate. For example, the fabric conditioning agent can be loaded to a level of about 10 lb/3000 $ft^2$ to about 30 lb/3000 $ft^2$. In addition, the amount of fabric conditioning agent can be loaded onto the nonwoven substrate in an amount of about 15 lb/3000 $ft^2$ to about 25 lb/3000 $ft^2$. It is to be understood that the dryer sheet for use in an individual dryer can be cut down to a size of less than about 80 $in^2$.

The above specification provides a complete description of the manufacture and use of the composition of the invention. Since many embodiments of the invention can be made without departing from the spirit and scope of the invention, the invention resides in the claims hereinafter appended.

We claim:

1. A single ply dryer sheet comprising:

(a) a nonwoven substrate comprising a mixture of wood fiber and polylactide fiber, wherein the mixture comprises about 2 wt. % to about 55 wt. % of the polylactide fiber and about 50 wt. % to about 95 wt. % of the wood fiber, and the nonwoven substrate comprises a creped substrate having an elongation of about 4% to about 30% in the machine direction according to Tappi Test T494, and wherein the nonwoven substrate has a basis weight of about 10 lb/3000 $ft^2$ to about 30 lb/3000 $ft^2$ and an air permeability of at least 6 CFM according to Tappi T251 CM-85; and (b) fabric conditioning agent provided on the nonwoven substrate, wherein the single ply dryer sheet comprises about 10 lb/3000 $ft^2$ to about 30 lb/3000 $ft^2$ of the fabric conditioning agent on the nonwoven substrate, wherein at least a portion of the fabric conditioning agent transfers from the nonwoven substrate to the laundry once the temperature within the tumble-type dryer is greater than about 120° F.

2. A single ply dryer sheet according to claim 1, wherein the wood fiber comprises a blend of hardwood fibers and soft wood fibers.

3. A single ply dryer sheet according to claim 1, wherein the polylactide fiber comprises polylactide having a melting temperature of at least about 200° F.

4. A single ply dryer sheet according to claim 1, wherein the fabric conditioning agent comprises a quaternary ammonium compound.

5. A single ply dryer sheet according to claim 4, wherein the quaternary ammonium compound comprises at least one of alkylated quaternary ammonium compounds, ring or cyclic quaternary ammonium compounds, aromatic quaternary ammonium compounds, diquaternary ammonium compounds, alkylated quaternary ammonium compounds, amidoamine quaternary ammonium compounds, ester quaternary ammonium compounds, and mixtures thereof.

6. A single ply dryer sheet according to claim 4, wherein the quaternary ammonium compound comprises a tallow based quaternary ammonium compound or a vegetable based quaternary ammonium compound.

7. A single ply dryer sheet according to claim 1, wherein the single ply dryer sheet is biodegradable according to ASTM D 6868-03.

8. A single ply dryer sheet according to claim 1, wherein the creped substrate comprises about 15 to about 100 crepe lines per lineal inch.

9. A single ply dryer sheet according to claim 1, wherein the polylactide fiber has a fiber length of about 3 mm to about 6 mm.

10. A single ply dryer sheet according to claim 1, wherein the polylactide has a denier of about 0.5 to about 10.

11. A single ply dryer sheet according to claim 1, wherein the nonwoven substrate comprises about 0.5 wt. % to about 25 wt. % binder.

12. A single ply dryer sheet according to claim 11, wherein the binder comprises a latex comprising at least one of polyacrylate, styrene, butadiene, copolymer, styrene acrylic copolymer, ethylene, vinyl acetate copolymer, nitrile rubber, polyvinyl chloride, polyvinyl acetate, ethylene acrylate copolymer, vinyl acetate acrylate copolymer.

13. A single ply dryer sheet according to claim 1, wherein the single ply dryer sheet comprises of about 0.1 wt. % to about 8 wt. % wet strength additive.

14. A single ply dryer sheet according to claim 13, wherein the wet strength additive comprises at least one of urea formaldehyde resin, melamine formaldehyde resin, polyamide, polyacrylamide, polyimine, polyethyleneimine, wet end latex, or size press latex.

15. A single ply dryer sheet according to claim 1, wherein the nonwoven substrate comprises a creped substrate having an elongation of about 4% to about 10% in the machine direction according to Tappi Test T494.

16. A method for manufacturing a single ply dryer sheet comprising:

(a) forming a nonwoven substrate from a mixture of wood fiber and polylactide fiber by a wet laid process, wherein the mixture comprises about 2 wt. % to about 55 wt. % of the polylactide fiber and about 50 wt. % to about 95 wt. % of the wood fiber;

(b) creping the nonwoven substrate to form a creped substrate having an elongation of about 4% to about 30% in the machine direction according to Tappi Test T494, and wherein the nonwoven substrate has a basis weight of about 10 lb/3000 $ft^2$ to about 30 lb/3000 $ft^2$ and an air permeability of at least 6 CFM according to Tappi T251 CM-85; and (c) loading a fabric conditioning agent onto the nonwoven substrate to form the single ply dryer sheet, wherein the single ply dryer sheet comprises about 10 lb/3000 $ft^2$ to about 30 lb/3000 $ft^2$ of the fabric conditioning agent on the nonwoven substrate, wherein at least a portion of the fabric conditioning agent transfers from the nonwoven substrate to the laundry once the temperature within the tumble-type dryer is greater than about 120° F.

17. A method according to claim 16, wherein the wood fiber comprises a blend of hardwood fibers and soft wood fibers.

18. A method according to claim 16, wherein the fabric conditioning agent comprises a quaternary ammonium compound.

19. A method according to claim 18, wherein the quaternary ammonium compound comprises a tallow based quaternary ammonium compound or a vegetable based quaternary ammonium compound.

20. A method according to claim 16, wherein the single ply dryer sheet is biodegradable according to ASTM D 6868-03.

21. A method according to claim 16, wherein the step of creping comprises creping the nonwoven substrate to form about 15 to about 100 crepe lines per lineal inch.

22. A method for conditioning laundry comprising:

drying wet laundry in a tumble-type dryer in the presence of a single ply dryer sheet, the dryer sheet comprising;

(a) a nonwoven substrate comprising a mixture of wood fiber and polylactide fiber, wherein the mixture comprises about 2 wt. % to about 55 wt. % of the polylactide fiber and about 50 wt. % to about 95 wt. % of the wood fiber, and the nonwoven substrate comprises a creped substrate having an elongation of about 4% to about 30% in the machine direction according to Tappi Test T494, and wherein the nonwoven substrate has a basis weight of about 10 lb/3000 $ft^2$ to about 30 lb/3000 $ft^2$ and an air permeability of at least 6 CFM according to Tappi T251 CM-85;

(b) fabric conditioning agent, wherein the single ply dryer sheet comprises about 10 lb/3000 $ft^2$ to about 30 lb/3000 $ft^2$ of the fabric conditioning agent on the nonwoven substrate, wherein at least a portion of the fabric conditioning agent transfers from the nonwoven substrate to the laundry once the temperature within the tumble-type dryer is greater than about 120° F.

23. A method according to claim 22, wherein the single ply dryer sheet is biodegradable according to ASTM D 6868-03.

24. A method according to claim 22, wherein the creped nonwoven substrate comprises about 15 to 100 crepe lines per lineal inch.

* * * * *